US005174777A

United States Patent [19]

Carter

[11] Patent Number: 5,174,777

[45] Date of Patent: Dec. 29, 1992

[54] HIGH AMPERAGE ELECTRICAL CONNECTORS

[75] Inventor: D. Paul Carter, Laguna Niguel, Calif.

[73] Assignee: PAR Marketing, El Toro, Calif.

[21] Appl. No.: 796,006

[22] Filed: Nov. 22, 1991

[51] Int. Cl.[5] ..... H01R 23/27

[52] U.S. Cl. ..... 439/290; 439/295; 439/387; 439/825

[58] Field of Search ..... 439/284-295, 439/387, 825, 827

[56] References Cited

U.S. PATENT DOCUMENTS

| | | | |
|---|---|---|---|
| Re. 32,760 | 10/1988 | Chandler et al. | 439/188 |
| 350,293 | 10/1886 | Cox | 439/290 |
| 366,654 | 7/1887 | Duby et al. | 439/287 |
| 460,048 | 9/1891 | Farwell | 439/290 |
| 1,159,567 | 11/1915 | Burton | 439/287 |
| 1,237,857 | 8/1917 | Averill | 439/295 |
| 2,838,739 | 6/1958 | Winkler | 439/295 |
| 3,337,836 | 8/1967 | Churla, Jr. | 439/295 |
| 3,594,695 | 7/1971 | Wofford | 439/293 |
| 3,688,243 | 8/1972 | Yamada et al. | 439/295 |
| 3,794,957 | 2/1974 | Winkler | 439/295 |
| 4,335,931 | 6/1982 | Kinnear | 439/295 |
| 4,693,102 | 9/1987 | Gettig et al. | 439/295 |
| 4,695,110 | 9/1987 | Wasserlein | 439/289 |
| 4,711,508 | 12/1987 | Sueyoshi | 439/595 |
| 4,737,118 | 4/1988 | Lockard | 439/289 |
| 4,744,769 | 5/1988 | Grabbe et al. | 439/284 |

*Primary Examiner*—Neil Abrams
*Attorney, Agent, or Firm*—Frank J. Uxa

[57] ABSTRACT

A hemaphroditic electrical connector, preferably for use in high amperage applications, is disclosed. The connector comprises two substantially identically configured terminal elements adapted to be coupled together. Each of the terminal elements includes a conductive body, an elongated spring member and an open cup adapted to receive a portion of the elongated spring member and the conductive body of the other of the terminal elements when the terminal elements are coupled together.

20 Claims, 3 Drawing Sheets

HIGH AMPERAGE ELECTRICAL CONNECTORS

BACKGROUND OF THE INVENTION

The present invention relates to electrical connector systems. More particularly, the invention relates to hermaphroditic electrical connector systems for use in heavy duty, high amperage applications.

Electrical connector systems are used extensively in many applications. One particularly important application involves making an electrical connection in which a relatively large amount of electrical current, for example, at least about 100 amperes, flows through the connector, such as in heavy duty, that is relatively high voltage, situations. Care must be taken in these applications to avoid incomplete and/or inefficient coupling of the connector components and to avoid excessive temperature increases as the current is flowing through the connector. Also, it is important that the electrical resistance across such connectors be controlled, for example, at a relatively low level.

One example of an application for a heavy duty, high amperage electrical connector system is as a fire wall connector between a jet engine and an auxiliary power unit on an airplane. Conventional connector systems involve coupled male/female components, which can provide for only relatively limited conductive contact surface. Excessive connector temperature build up can result and ultimately lead to a permanent welding of the connector components. The subsequent heat/temperature rise can cause a catastrophic electrical failure within the connector, which would have a substantial adverse impact on the overall system, for example, the airplane, in which the connector is employed.

An electrical connector should be useful to provide a safe and effective electrical connection even with one of the connector components being "hot", i.e., having a substantial electrical potential. In many instances in the past, this has not been possible in that the initial contact between the "hot" connector component and the other connector component resulted in an excessive electrical load being placed on the points of contact between the connector components so that there was substantial risk of a shorting out of or other damage to the connector system.

A new connector system, particularly a high amperage electrical connector system, which reduces the adverse impact of, or even substantially avoids, these problems would be advantageous.

SUMMARY OF THE INVENTION

New electrical connector systems have been discovered. These electrical connectors are particularly applicable for heavy duty, high amperage applications, and provide for a very effective and efficient electrical connection even when the amount of current flowing is at least about 100 amps or amperes, preferably at least about 250 amps and still more preferably at least about 300 amps. The present connector components provide substantial contact surface so that the temperature rise as a result of current flow is effectively controlled. In addition, highly effective initial contact between the connector components is provided. This controls the heat initially generated at the connector and allows the connector to be safely joined while one of the components is "hot". Further, the present connectors are preferably structured so that as the temperature increases in the coupled connector, the force coupling the connector components is also increased.

One important feature of the preferred connectors of the present invention is that the components of such connectors are structured so that as the temperature in the coupled connector increases, the electrical resistance across the connector is reduced. This feature reduces the electrical losses across the connector, as well as aiding in controlling the temperature in the connector.

Each of the advantages of the present connectors is particularly beneficial when heavy duty, high amperage loads are involved.

In one broad aspect, the present electrical connectors comprise two substantially identically configured terminal elements adapted to be coupled together to allow electrical current to flow from one of the terminal elements to the other of the terminal elements. These terminal elements, because they are substantially identically configured, may be considered hermaphroditic terminal elements, and the coupled terminal elements or coupled electrical connector may be considered a hermaphroditic electrical connector.

Each of the two terminal elements includes a conductive body having a distal end portion and a proximal end portion, is joined to or otherwise in electrical communication with one or more electric wires and/or cables, and includes a substantially straight or flat surface extending from the proximal end portion toward the distal end portion. This substantially flat surface, which preferably has a length equal to at least about 20% and more preferably at least about 40% of the length of the entire conductive body, is adapted to face, and preferably to come in contact in at least one area with, the substantially flat surface of the other of the terminal elements when the terminal elements are coupled together. A conductive, elongated spring member is provided, and is carried by the conductive body, preferably on or near a surface substantially opposite the substantially flat surface noted above. This elongated spring element preferably extends from the proximal end portion to the distal end portion of the conductive body.

An open cup, defined by the proximal end portion of the conductive body and the substantially flat surface of the conductive body, is adapted to receive the distal end portion and a portion of the elongated spring member of the other of the terminal elements when the terminal elements are coupled together. The open cup preferably is partially defined by an angled surface of the proximal end portion of the conductive body which is spaced apart from the substantially flat surface of the conductive body. This angled surface angles away from the substantially flat surface, more preferably at an angle in the range of about 5° to about 30°, in the direction toward the distal end portion of the conductive body. The open cup is more preferably partially defined by an end surface located between the substantially flat surface and the angled surface, which end surface may be advantageously located substantially perpendicular to the substantially flat surface. The configuration of the open cup, and especially the preferred and more preferred embodiments of the open cup, is preferably such as to facilitate a more strong or more secure coupling of the terminal elements as the temperature increases and/or reduced connector electrical resistance as the temperature of the coupled connector increases.

As noted above, the present connector systems are preferably structured so that the electrical resistance of the coupled together terminal elements is reduced with increasing temperatures, more preferably with increasing temperatures in the range of about 20° C. to about 180° C.

The conductive body of the present terminal elements provides a main or primary electrical contact when the terminal elements are fully coupled together.

In one embodiment, the distal end portion of the conductive body is at least generally tapered, preferably from large to small, toward the distal end of the conductive body. Such tapering facilitates maintaining the terminal elements coupled together and further acts to reduce heat build-up in connector.

The conductive body comprises an electrically conductive material, in particular a metallic material, such as a copper alloy. Examples of useful materials which may be included in the conductive body are beryllium/-copper alloy, brass, copper itself (drawn copper), bronze, stainless steel, and the like. Of these materials, brass is particularly useful in that it has very good electrical conductivity and is easy to fabricate into the desired configuration of the conductive body. The conductive body may be coated or plated with a highly electrically conductive material, such as gold and the like metals.

The elongated spring element preferably includes a distal end in proximity to the distal end portion of the conductive body. The conductive body preferably includes a groove adapted to receive the elongated spring member. The elongated spring member is preferably structured or biased so that the distal end of the spring member to be out of contact with the distal end portion of the conductive body.

One important function of the elongated spring member is to provide an effective initial contact as the terminal elements are being coupled together. Thus, the elongated spring member has sufficient contact area with the conductive body of the other terminal element so that a safe and effective initial contact is provided, even when one of the terminal elements is "hot", thus reducing the risk of localized hot spots, which can be detrimental to the structural integrity of the connector system.

One additional important function of the elongated spring member is to provide for secure coupling of the terminal elements. The elongated spring member preferably has a different, more preferably decreased, coefficient of thermal expansion relative to the conductive body. For example, this elongated spring member may comprise a metallic material, such as stainless steel, which may be coated or plated with a highly electrically conductive material, such as gold and the like metals. The difference in the coefficients of thermal expansion of the conductive body and the elongated spring member and/or the configuration of the open cup act to at least assist in providing a more secure or more strong coupling of the terminal elements and/or reduced connector electrical resistance as the temperature in the coupled terminal elements increases, for example, during use.

The elongated spring member preferably includes a substantially flat portion, an angled portion and an end portion which is substantially perpendicular to the longitudinal axis of the elongated spring member. The angled portion and substantially perpendicular end portion are located at or near the distal end region of the elongated spring member. A plurality of finger-like prongs which extend to the distal end of the elongated spring member are preferably provided. This configuration of the elongated spring member is adapted to provide for very effective contact between the elongated spring member and conductive body during use (in a coupled connector) and for very effective and secure coupling of the terminal elements.

The elongated spring member has a width which is preferably substantially coextensive with, or smaller than, the width of the conductive body. In one embodiment, the substantially flat portion of the elongated spring is located in proximity to a substantially flat region of the conductive body. The substantially flat portion and the substantially flat region are positioned to be in contact when the terminal elements are coupled together so that there is very effective electrical contact between the elongated spring member and the conductive body along a substantial, even major (at least about 50%), portion of the length of the elongated spring member.

The elongated spring member is preferably fastened to the conductive body. In a particularly useful construction, the elongated spring member includes an outwardly extending portion and the conductive body includes a groove for receiving the elongated spring member and an indent sized and adapted to receive and hold this outwardly extending portion. By positioning the elongated spring member in the groove so that the outwardly extending portion is received by the indent, the elongated spring member is effectively fastened to the conductive body.

The open cup is preferably configured so that the distal end of the elongated spring member of the other terminal element contacts the conductive body when the terminal elements are coupled together.

Each of the present terminal elements preferably includes a cleaning spring member adapted to contact the substantially flat surface of the other of the terminal elements as the terminal elements are coupled together. In this way, the substantially flat surface of the conductive body is maintained so as to be very effective and highly conductive. The cleaning spring member, which may be made of the same or a different material than the elongated spring member, may be secured to the conductive body by clips which are located in one or more notches in the conductive body. Locating the clips in such notch or notches substantially reduces the risk of any dislocation of the cleaning spring member as the terminal elements are coupled and uncoupled.

The present connectors preferably include one or more electrically insulating housing components adapted to effectively electrically insulate the coupled together terminal elements. In a particularly useful configuration, the insulating housing component or components are configured to facilitate the coupling together of the terminal elements. Housing components made of ceramic and the like electrically insulating materials are very effective.

These and other aspects and advantages of the present invention will be apparent in the following detailed description and claims, particularly when considered in conjunction with the accompanying drawings in which like parts bear like reference numerals.

DETAILED DESCRIPTION OF THE DRAWINGS

Figure 2:
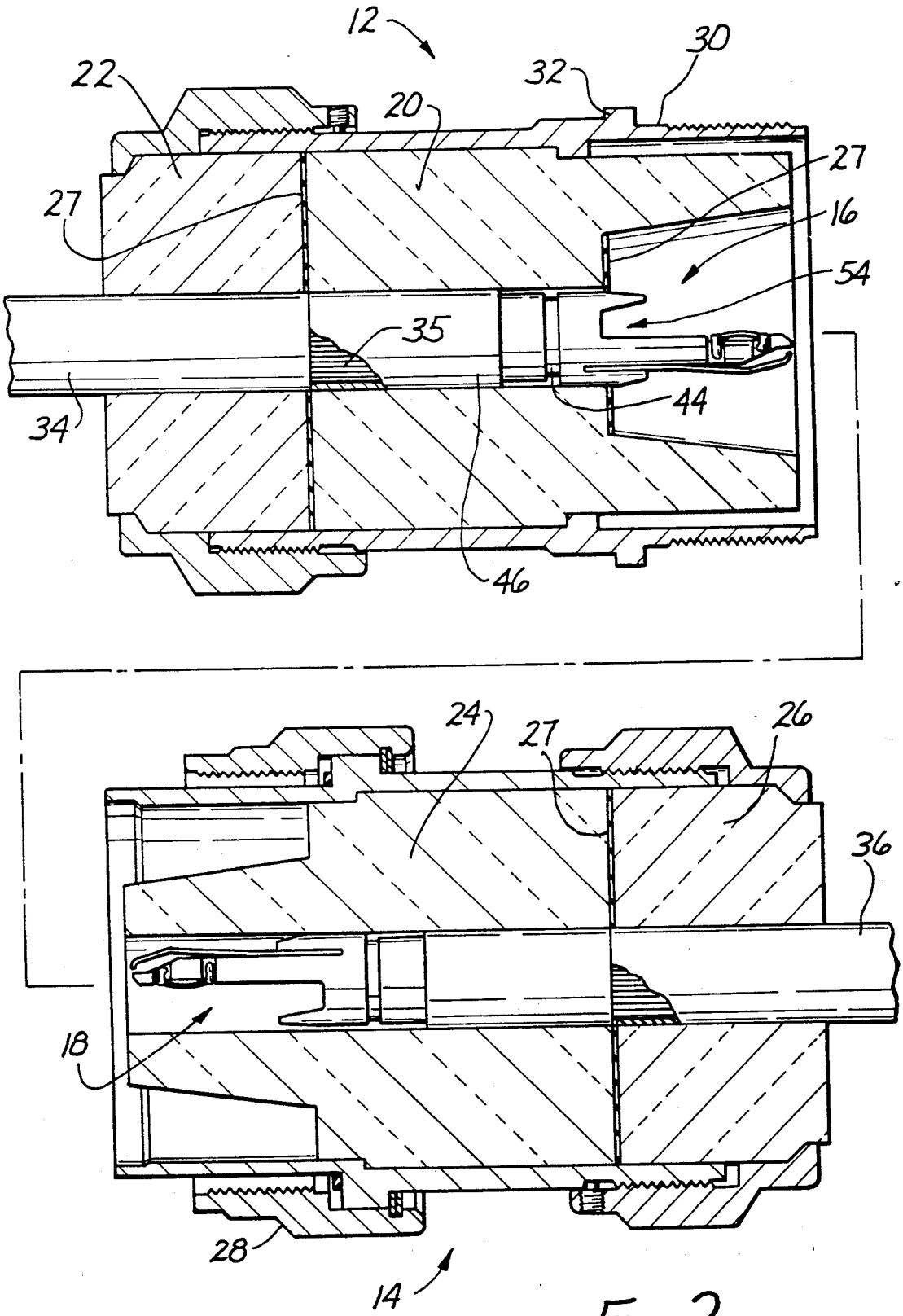
FIG. 2 is a cross sectional view of the connector shown in FIG. 1.
Figure 3:
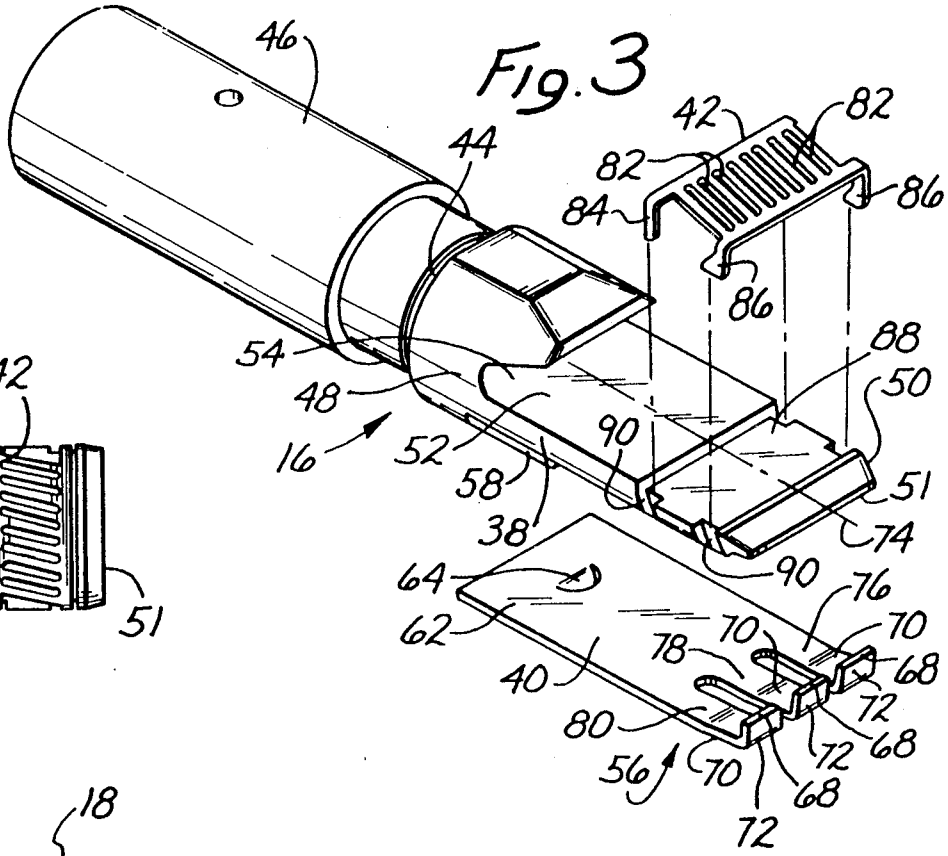
FIG. 3 is an exploded view, in perspective, of one terminal element of the connector shown in FIG. 1.
Figure 5:
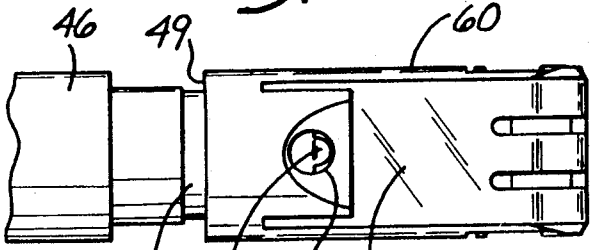
FIG. 5 is a top plan view of the terminal element shown in FIG. 4.
Figure 6:
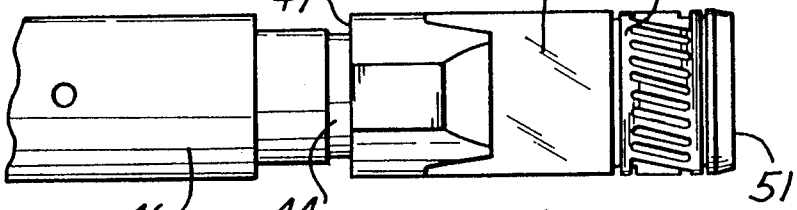
FIG. 6 is a bottom plan view of the connector shown in FIG. 4.

Referring now to the drawings, an embodiment of the present electrical connector, shown generally at 10, includes a first coupling assembly 12, and a second coupling assembly 14. First coupling assembly 12 holds first connector terminal 16, while second coupling assembly 14 holds second connector terminal 18, as shown in FIG. 2.

Included within and held substantially stationary (relative to assembly 12) by first coupling assembly 12 are first electrically insulating housing elements 20 and 22. Second coupling assembly 14 includes second electrically insulating housing elements 24 and 26 and holds these second housing elements substantially stationary (relative to assembly 14). Each of these housing elements is made of a conventional electrically insulating ceramic material. In addition, the housing elements 20, 22, 24 and 26 include through holes which are sized to allow the first and second connector terminals 16 and 18, respectively and the distal ends of first and second electrical cables 34 and 36, respectively,, to be placed in position, as best shown in FIG. 2. The through hole in first housing element 22 is sized so that first cable 34 is held stationary relative to element 22. Similarly, the through hole in second housing element 26 is sized so that second cable 36 is held stationary relative to element 26. An adhesive may be employed to secure first cable 34 in the through hole of first housing element 22 and second cable 36 in the through hole of second housing element 26. Electrically insulating, thin, polymeric discs 27 are placed on a number of the surfaces of the housing elements to provide a cushion against damage as a result of contact between the housing elements.

First and second connector terminals 16 and 18 are positioned relative to each other so that they can be easily coupled. The through holes in the housing elements 20, 22, 24 and 26 are positioned off-center (the central axis of the through holes is not co-incidental with the central axis of the housing elements) in order to facilitate the coupling of the connector terminals 16 and 18. Thus, by bringing first and second coupling assemblies 12 and 14 together to be coupled, the first and second connector terminals 16 and 18 are also properly positioned for coupling. In other words, the insulating housing elements 20, 22, 24 and 26, together with the coupling assemblies 12 and 14, are sized and structured so that the connector terminals 16 and 18 can be coupled in a easy and straight forward manner. First housing element 20 and second housing element 24 may be considered extended creepage barriers in that such elements reduce the risks involved from unintentional sparking as the connector terminals are coupled and the coupled connector is used.

The first coupling assembly 12 and the second coupling assembly 14 are structured to hold the first insulating housing elements 20 and 22 and the second insulating housing elements 24 and 26, respectively, in place and, in addition, can be secured or coupled together after the first connector terminal 16 and the second connector terminal 18 have been coupled, for example, to provide additional protection for the coupled terminals. The functioning of the first and second coupling assemblies 12 and 14 is conventional and, therefore, no detailed description of such functioning is provided. However, it is clear from the drawings that once the first and second connector terminals 16 and 18 are coupled together, as described herein, the rotatable coupling element 28 of second coupling assembly 14 is threaded onto the forward coupling element 30 of first coupling assembly 12.

The connector 10 can be positioned by fastening plate 32 to the location where the connector is to be used, e.g., the firewall between a jet engine and an auxiliary power unit in an airplane. In this manner, the connector 10 is adaptable for use, in much the same way as conventional connectors are employed.

First connector terminal 16 is secured to first electrical cable 34, whereas second connector terminal 18 is connected to second electrical cable 36. Using the coupled first and second connector terminals 16 and 18, heavy duty, high amperage loads can be passed from first electrical cable 34 to second electrical cable 36, or vice versa.

First and second connector terminals 16 and 18 are identically structured. Therefore, only the first connector terminal 16 is described in detail, it being understood that the second connector terminal 18 includes components which are structured substantially identically. The components of second connector terminal 18 which are referred to herein are identified with the same reference numeral as the corresponding components of first connector terminal 16, together with an additional "a". To illustrate, the conductive body of the first connector terminal 16 is identified by the reference numeral "38" and the conductive body of the second connector terminal 18 is identified by the reference numeral "**38*a***".

With specific reference to FIGS. 3, 4, 5 and 6, first connector terminal 16 includes a conductive body 38, an elongated spring element 40 and a cleaning spring member 42. Conductive body 38 is integral with a conductive extension 44 which is welded, brazed or otherwise secured to a first cable extension 46. The electrically conductive wires 35 within first electrical cable 34 are secured in electrical communication with first cable extension 46. First electrical cable 34 is crimped or otherwise secured to first cable extension 46. In this manner, first electrical cable 34 is in electrical communication with first connector terminal 16.

Conductive body 38 is made of brass and is plated with gold. First conductive body 38 includes a proximal end portion 48, a distal end portion 50 and a substantially flat surface 52 which extends from the proximal end portion toward the distal end portion and has a length equal to approximately 50% of the length of the conductive body 38 from the proximal end 49 of the proximal end portion 48 to the distal end 51 of the conductive body.

The proximal end portion 48 together with the substantially flat surface 52 define a distally open cup 54 which functions in the coupling of the first and second connector terminals 16 and 18, as is described hereinafter. Open cup 54 is partially defined by angled surface 55 which is substantially opposite substantially flat surface 52, and by end surface 57 which is substantially perpendicular to substantially flat surface 52. The shape of the cup 54 is such as to accommodate the distal end portion 50 of the conductive body 38 as well as the distal end region 56 of the elongated spring element 40. The distal end portion 50 of the conductive body 38 is generally tapered, from a larger proximal cross sectional area to a generally smaller distal cross sectional area.

The conductive elongated spring element 40 is made of stainless steel, and may be plated with gold, and has a lower or decreased coefficient of thermal expansion than does the conductive body 38. Elongated spring element 40 is placed in a groove 58 which is located in the proximal end portion 48 of conductive body 38 and is partially defined by a surface 60 which is substantially opposite the flat surface 52. The proximal end region 62 of elongated spring element 40 is placed in groove 58. Proximal end region 62 includes an outwardly extending flap 64 which is positioned to be received in hole 66 located in the proximal end portion 48 of conductive body 38. With flap 64 received and held in hole 66, elongated spring element 40 is fastened to conductive body 38.

Figure 1:
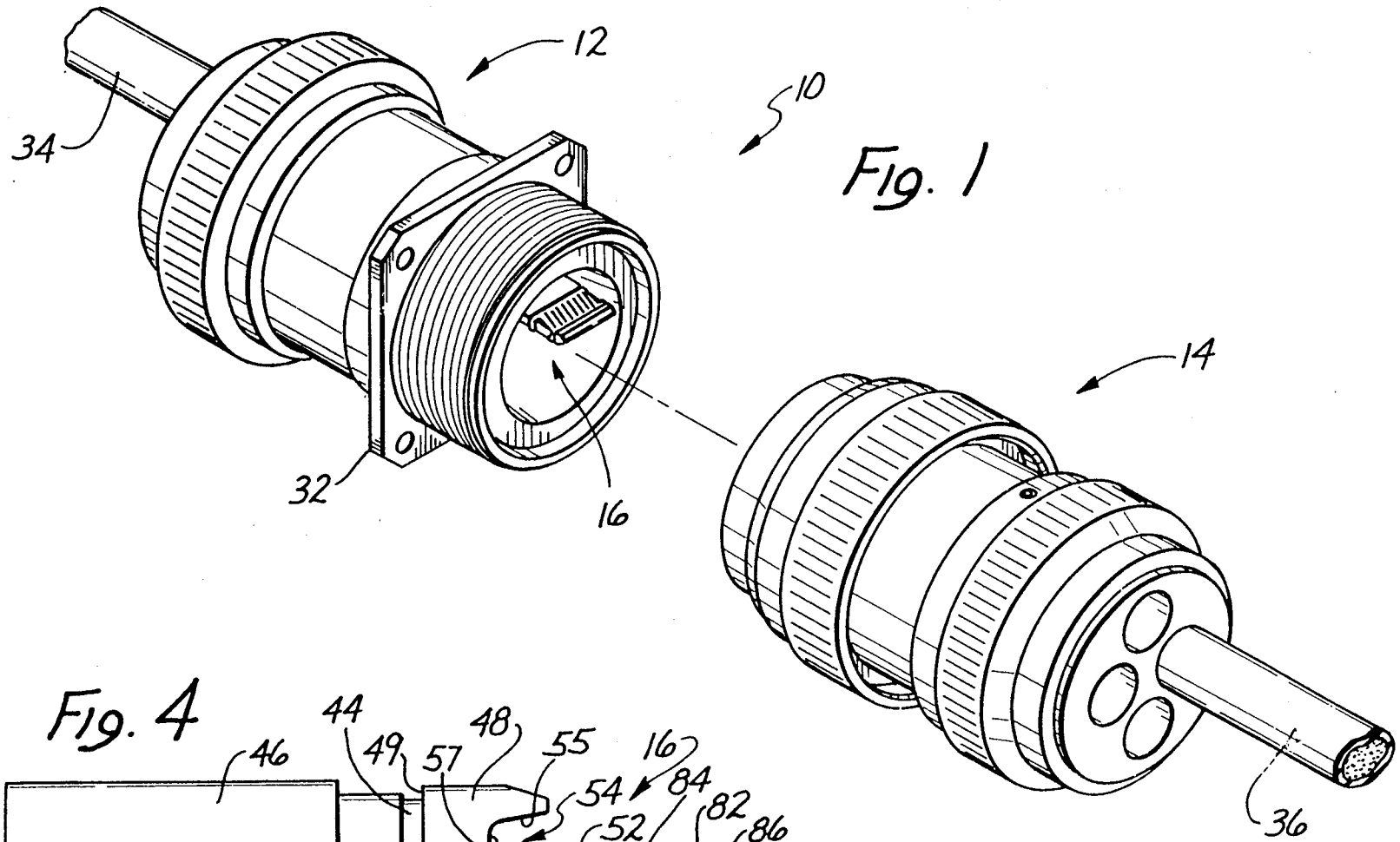
FIG. 1 is a front side view, in perspective of a connector in accordance with the present invention.
Figure 4:
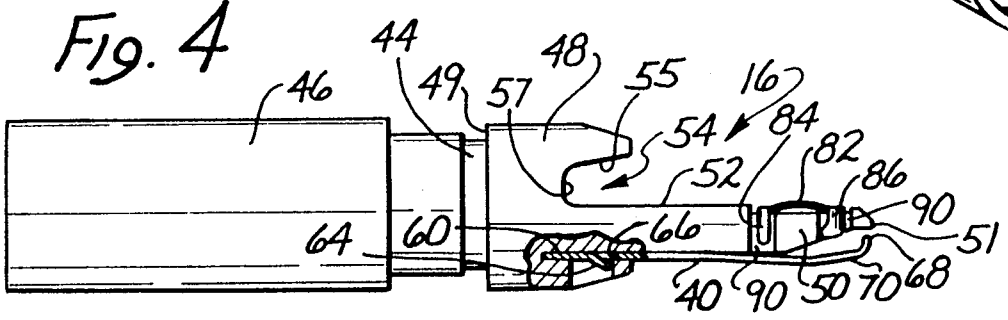
FIG. 4 is a side plan view, partly in ,cross section, of one of the terminal elements of the connector shown in FIG. 1.

As shown in FIG. 4, elongated spring element 40 extends along and is in contact with surface 60 of conductive body 38 a substantial portion of the distance toward the distal end portion 50 of the conductive body. Thus, there is effective electrical contact between the elongated spring element 40 and the conductive body 38 along surface 60.

The distal end region 56 of elongated spring element 40 is separated from, that is not in contact with, the distal end portion of the conductive body 38 when the first connector terminal 16 is not coupled to the second connector terminal 18. This is best shown in FIG. 4. The elongated spring element 40 is biased or structured so as to keep the distal end segments 68 of elongated spring element 40 out of contact with the conductive body 38 when the first connector terminal 16 is uncoupled, again shown in FIG. 4. The distal end region 56 of the elongated spring element 40 includes angled portions 70, and segments 72 which is substantially perpendicular to the longitudinal axis 74 of first connector terminal 16. Distal end region 56 of elongated spring element 40 includes a series of three finger-like prongs 76, 78 and 80 which include the angled portions 70 and the segments 72. These prongs provide an effective biasing action and further provide for effective electrical contact, particularly effective initial electrical contact as the first and second connector terminals 16 and 18 are being coupled.

Cleaning spring member 42 is made of stainless steel plated with gold and includes a series of bowed spring elements 82 which extend upwardly from the conductive body 38. These bowed spring elements 82 function to contact the substantially flat surface 38*a* of second connector terminal 18 as the first and second connector terminals 16 and 18 are being coupled so as to clean surface 38*a* to provide effective electrical conductivity. Cleaning spring member 42, which also acts to provide electrical contact surface when the first and second terminals 16 and 18 are coupled, includes clips 84 and 86 which act to fasten cleaning spring 42 to conductive body 38. Conductive body 38 is configured to include an indent 88 into which the cleaning spring 42 is placed. In addition, conductive body 38 includes a series of notches 90 which allow the clips 84 and 86 to fasten the cleaning spring member 42 to the conductive body 38 without having the clips extend beyond the width of the conductive body 38. This prevents the clips 84 and 86 from acting to dislocate the cleaning spring member 42 when the connector terminals 16 and 18 are being coupled or uncoupled.

Electrical connector 10 functions as follows. When it is desired to couple first connector terminal 16 to second connector terminal 18, the second coupling assembly 14 is brought into proximity to the first coupling assembly 12. The coupling assemblies 12 and 14 are positioned so that the second connector terminal 18 can be coupled to the first connector 16 very conveniently. As this coupling occurs, the elongated spring element and the distal end portion of the conductive body of each connector terminal are received by the open cup of the other connector terminal. The initial electrical contact occurs between the elongated spring element and the proximal end portion of the conductive body of the other terminal. As the coupling is completed, the distal end region of the elongated spring element of each connector terminal is made to contact the distal end portion of the conductive body of the same connector terminal. As the temperature increases in the connector 10 as a result of current flowing through the coupled connector, the force holding the elongated spring elements and distal end portions of the conductive bodies in the open pockets increases, thus making the coupling more secure. This is particularly effective when the material used to fabricate the elongated spring elements has an increased coefficient of thermal expansion relative to the material used to fabricate the conductive bodies.

Figure 7:
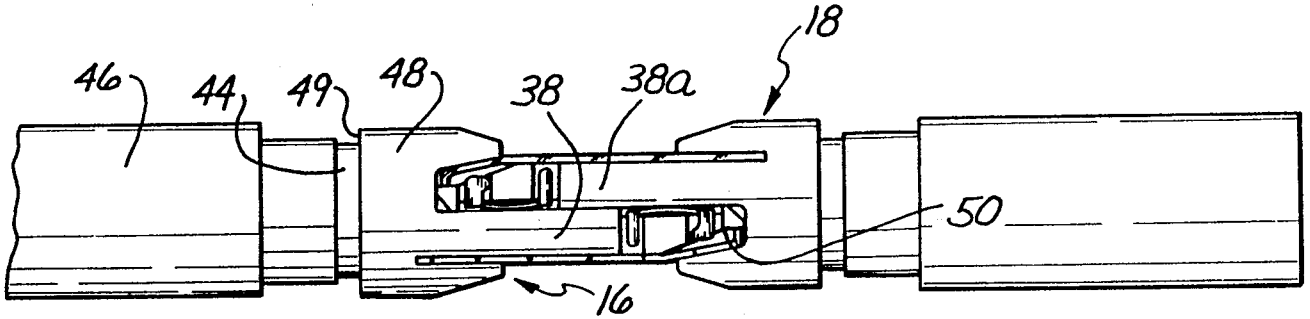
FIG. 7 is a side plan view showing the terminal elements of the connector shown in FIG. 1 coupled together.

With reference to FIG. 7 which shows the two connector terminals coupled together, note that the coupled connector 10 includes a number of open spaces which provide for effective heat dissipation, without substantially detrimentally affecting the quality of the electrical connection. Thus, the temperature rise in the coupled connector 10 is preferably lower than what might be expected if the connector provided for a complete or solid contact with no air spaces or gaps. In addition, the electrical resistance across the conductor 10 is controlled, and preferably reduced, with increasing temperatures, for example, in the range of about 20° C. to about 160° C. Once the first and second connector elements 16 and 18 have been coupled, the first and second coupling assemblies 12 and 14 can be joined, in a conventional manner, to provide a completed and fully insulated connector system.

The present connector systems may include, or be associated with, one or more other components, such as conventional and well known components, which perform one or more functions in and/or provide one or more benefits to the present systems. Systems which include one or more of such other components are included within the scope of the present invention, particularly when such component or components have no substantial or undue detrimental effect on the present systems.

The following non-limiting examples illustrate certain aspects of the present invention.

EXAMPLE 1

A connector substantially as shown in the drawings was selected for testing. The diameter of the proximal end portion of each of the conductive bodies was 0.844 inches. The coupled connector terminals were run for 60 minutes with a current of 340 amps being passed through the connector. The temperature in the connector was measured, as well as the electrical resistance across the connector as the result of the current flow.

The connector was run in two modes, one with the connector confined by the insulating housing components and the coupling assemblies and one in the open air in which the connector was not covered. Results of these tests were as follows:

TABLE I

| MODE | TEMPERATURE, °C. START/FINISH | CONNECTOR RESISTANCE, MILLIOHMS($10^{-3}$ OHMS) START/FINISH |
|---|---|---|
| CONFINED | 22.9/69.6 | 1.2/.76 |
| OPEN AIR* | 21.6/108.2 | .33/32 |
| OPEN AIR* | 21.6/103.7 | .33/32 |

*DUPLICATE RUNS

These results indicate that the present connector provides for a very effective electrical connection, even in high duty, high amperage applications. One important feature of the present invention which is illustrated in the above example is that the resistance across the connector actually is decreased as the temperature in the connector increases over time. Also, the temperature increase is relatively low, thus making the present connector very effective in applications where excessive temperature rise would be detrimental.

EXAMPLE 2

The above Example 1 was repeated except that the diameter of the conductive body was 0.75 inches.

Results of these tests are as follows:

TABLE 2

| MODE | TEMPERATURE, °C. START/FINISH | CONNECTOR RESISTANCE, MILLIOHMS($10^{-3}$ OHMS) START/FINISH |
|---|---|---|
| CONFINED | 23.0/83.6 | 1.2/.76 |
| OPEN AIR* | 21.5/176.4 | .33/32 |
| OPEN AIR* | 21.7/155.8 | .36/32 |

*DUPLICATE RUNS

These results are substantially consistent with the results indicated in Example 1. It should be noted, however, that the temperature increases with the smaller connector are larger. This may be the result of reduced surface area, which leads to higher localized temperatures within the connector. Thus, where appropriate, the larger of two connectors should be employed in order to reduce the temperature rise caused by the current flow.

While this invention has been described with respect to various specific examples and embodiments, it is to be understood that the invention is not limited thereto and that it can be variously practiced within the scope of the following claims.

What is claimed is:

1. An electrical connector comprising:

two substantially identically configured terminal elements adapted to be coupled together to allow electrical current to flow from one of said terminal elements to the other of said terminal elements, each of said terminal elements comprising:

a conductive body having a distal end portion and a proximal end portion, and a substantially flat surface extending from said proximal end portion toward said distal end portion which is adapted to face the substantially flat surface of the other of said terminal elements when said terminal elements are coupled together;

a conductive, elongated spring member carried by said conductive body on or near a surface substantially opposite said substantially flat surface, said elongated spring member extending from said proximal end portion to said distal end portion; and an open cup defined by said proximal end portion and said substantially flat surface adapted to receive the distal end portion of the conductive body and a portion of the elongated spring member of the other of said terminal elements when said terminal elements are coupled together.

2. The connector of claim 1 which is structured to allow at least about 250 amperes to flow between the coupled together terminal elements.

3. The connector of claim 2 wherein the electrical resistance of the coupled together terminal elements is reduced with increasing temperatures in the range of about 20° C. to about 180° C.

4. The connector of claim 1 herein said elongated spring member includes a distal end in proximity to said distal end portion of said conductive body and said elongated spring member is biased to urge said distal end to be out of contact with said distal end portion.

5. The connector of claim 1 wherein said elongated spring member has a different coefficient of thermal expansion than said conductive body.

6. The connector of claim 1 wherein said elongated spring member has a decreased coefficient of thermal expansion relative to the coefficient of thermal expansion of said conductive body.

7. The connector of claim 1 wherein said elongated spring element comprises stainless steel.

8. The connector of claim 1 wherein said elongated spring member has a distal end, and said open cup is configured so that said distal end of said elongated spring member contacts said distal end portion of said conductive body when said terminal elements are coupled together.

9. The connector of claim 1 wherein said conductive body includes a groove adapted to receive said elongated spring member.

10. The connector of claim 1 wherein said elongated spring member includes a substantially flat portion, an angled portion and an end portion which is substantially perpendicular to the longitudinal axis of said elongated spring member.

11. The connector of claim 10 wherein said flat portion of said elongated spring member is located in proximity to a substantially flat region of said conductive body.

12. The connector of claim 1 wherein said conductive body has a width and said elongated spring member has a width which is substantially coextensive with or smaller than said width of said conductive body.

13. The connector of claim 1 wherein said elongated spring member is fastened to said conductive body.

14. The connector of claim 13 wherein said elongated spring member includes an outwardly extending portion and said conductive body includes an indent sized and adapted to receive and hold said outwardly extending portion.

15. The connector of claim 1 which further comprises a cleaning spring member adapted to contact the substantially flat surface of the other of said terminal elements as said terminal elements are being coupled together.

16. The connector of claim 15 wherein said cleaning spring member comprises stainless steel.

17. The connector of claim 15 wherein said cleaning spring member is secured to said conductive body by clips which are located in notches in said conductive body.

18. The connector of claim 1 which further comprises an electrically insulating housing adapted to effectively electrically insulate said coupled together terminal elements.

19. The connector of claim 18 wherein said insulating housing is configured to facilitate the coupling together of said terminal elements.

20. The connector of claim 1 wherein said open cup is partially defined by an angled surface of said proximal end portion which is spaced apart from said substantially flat surface and which angles away from said substantially flat surface in the direction toward said distal end portion.

* * * * *

UNITED STATES PATENT AND TRADEMARK OFFICE

CERTIFICATE OF CORRECTION

PATENT NO. : 5,174,777

DATED : December 29, 1992

INVENTOR(S) : D. Paul Carter

It is certified that error appears in the above-identified patent and that said Letters Patent is hereby corrected as shown below:

Column 3, line 13; after "in" insert --the--

Column 3, line 31; delete "or biased"

Column 3, line 32; after "member" insert --is biased--

Column 4, line 65; after "perspective" insert --,--

Column 5, line 36; delete "," second occurrence

Column 6, line 22; delete ","

Column 7, line 46; delete "is" and insert in place thereof --are--

Column 10, line 29; delete "herein" and insert in place thereof --wherein--

Column 12, line 5; after "said" insert --electrically--

Signed and Sealed this

Twenty-third Day of November, 1993

Bruce Lehman

*Attest:*

BRUCE LEHMAN

*Attesting Officer*

*Commissioner of Patents and Trademarks*